US005224226A

United States Patent [19]

Groenewald

[11] Patent Number: 5,224,226

[45] Date of Patent: Jul. 6, 1993

[54] BODY SUPPORT STRUCTURE

[76] Inventor: Petronella J. Groenewald, 5 Kompanjie Street, Kuilsriver 7580, South Africa

[21] Appl. No.: 957,817

[22] Filed: Oct. 8, 1992

[30] Foreign Application Priority Data

Sep. 16, 1991 [ZA] South Africa ..... 91/7351

[51] Int. Cl.[5] ..... A47C 27/16

[52] U.S. Cl. ..... 5/481; 5/632; 5/900.5

[58] Field of Search ..... 5/630, 632, 633, 481, 5/900.5, 901

[56] References Cited

U.S. PATENT DOCUMENTS

| | | | |
|---|---|---|---|
| 1,045,228 | 11/1912 | Weltmer | 5/632 X |
| 3,378,861 | 4/1968 | Lousberg | 5/632 X |
| 4,286,344 | 9/1981 | Ikeda | 5/900.5 X |
| 4,383,342 | 5/1983 | Forster | 5/900.5 X |
| 4,665,573 | 5/1987 | Fiore | 5/900.5 X |
| 4,955,091 | 9/1990 | Gilroy et al. | 5/900.5 X |
| 5,136,740 | 8/1952 | Kraft | 5/901 X |

*Primary Examiner*—Michael F. Trettel
*Attorney, Agent, or Firm*—Larson and Taylor

[57] ABSTRACT

A body support structure in the form of a mattress for supporting a person when lying thereon is provided. It comprises a body of resilient, compressible material, having a surface layer of resilient soft material. The body includes a head end edge and a foot end edge at its opposite end; two substantially parallel straight elongated side edges; a bottom face extending between the two side edges of the body; an upper face opposed to and spaced from the bottom face between the two side edges of the body; two spaced apart elongated ridges, one of the ridges extending along each side edge; a channel provided in the upper face extending between the two ridges, the channel joining smoothly to the two ridges on either side; a central raised part located in the channel between but distanced away from the opposite end edges and being positioned to support the lumbar region of a person lying in the channel and side parts provided on the ridges adjacent the central raised part.

4 Claims, 1 Drawing Sheet

BODY SUPPORT STRUCTURE

FIELD OF INVENTION

The present invention relates to a body support structure.

SUMMARY OF THE INVENTION

According to the invention, a body support structure in the form of a mattress for supporting a person when lying thereon, comprises a body of resilient, compressible material, having a surface layer of resilient soft material, the body including:

a head end edge, at one end of the body and a foot end edge at the opposite end of the body; two substantially parallel straight elongated side edges, one at either side of the body;

a bottom face extending between the two side edges of the body;

an upper face opposed to and spaced from the bottom face between the two side edges of the body;

two spaced apart elongated ridges, one of the ridges extending along each side edge, each ridge being substantially straight along the length thereof and having a semi-circular shape in cross-section;

a channel provided in the upper face extending between the two ridges, the channel joining smoothly to the two ridges on either side;

a central raised part located in the channel between but distanced away from the opposite end edges and being positioned to support the lumbar region of a person lying in the channel, and side parts are provided on the ridges adjacent the central raised part.

A wedge shaped cushion part may be provided extending from the central raised part to the head end edge.

Side raised parts may be provided on the ridges adjacent the central raised part.

The body, in addition to the surface layer of resilient soft material, may have a bottom layer of resilient material which is less soft than the material of the surface layer.

The surface layer may be constituted by undulations in the form of alternating cups and caps.

The structure may be a mattress.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
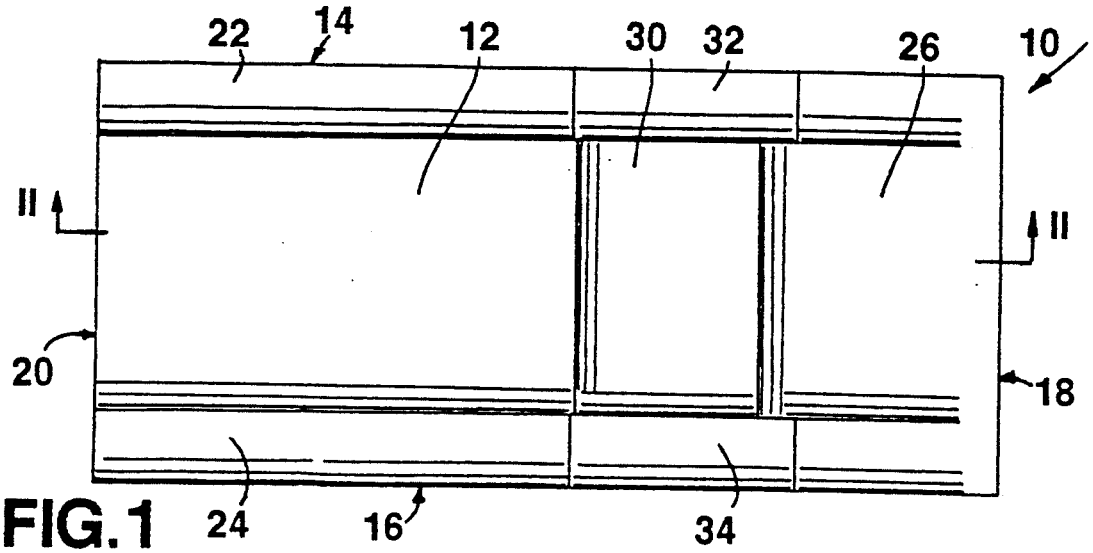
FIG. 1 a plan view of a body support structure in accordance with the invention.

Referring to FIG. 1, the body support structure, generally indicated by reference numeral 10, is in the form of a mattress. It includes a rectangular panel 12 having longitudinal side edges 14, 16, a head end edge 18 and a foot end edge 20.

Figure 2:
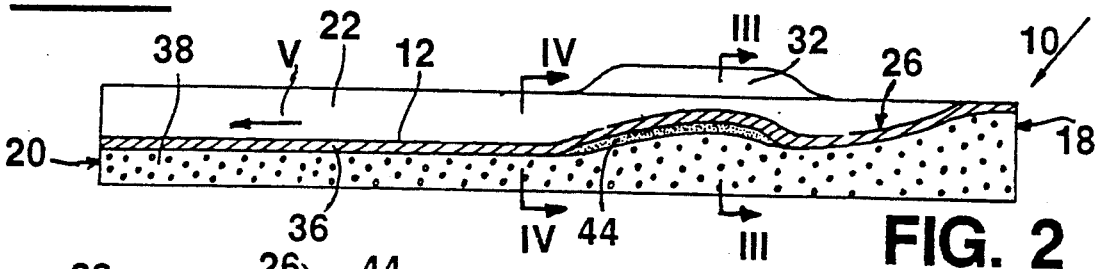
FIG. 2 a sectional side view seen along arrows II—II in FIG. 1.
Figure 3:
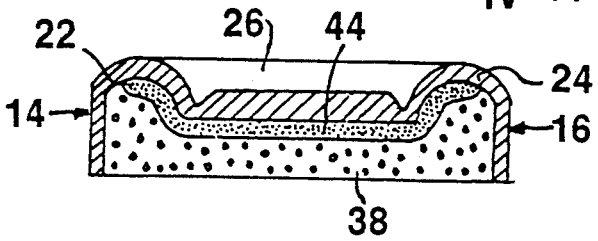
FIG. 3 a sectional end view seen along arrows III—III in FIG. 2.
Figure 4:
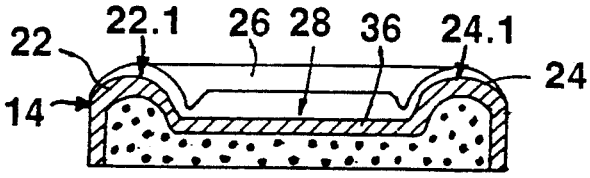
FIG. 4 a sectional end view seen along arrows IV—IV in FIG. 2.

Along the longitudinal sides 14, 16 ridges 22, 24, extend. As shown in FIGS. 2, 3 and 4 these ridges 22, 24 are curved substantially semi-circularly along their upper contours 22.1, 24.1 in end view.

From the head end edge 18 a wedge shaped part 26 in the form of a cushion is provided.

Between the ridges 22, 24 a channel 28 is defined extending from the foot edge 20 towards the head edge 18. The channel 28 passes smoothly over into a central raised part 30 which in turn extends smoothly into the cushion part 26. On either side of the raised part 30 and in line with the ridges 22, 24 side raised blocks 32, 34 are provided.

The structure 10 is composed of an upper layer 36 made of a soft resilient low density material, and a lower layer 38 made of resilient high density material, which is not as soft as the material of the upper layer 36.

Figure 5:
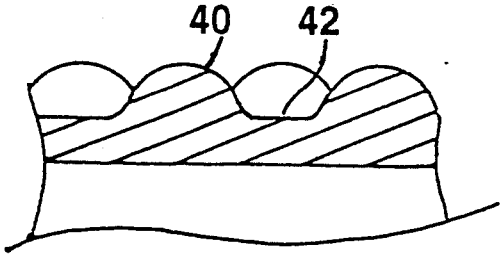
FIG. 5 on an enlarged scale, a sectional view of the upper surface of the body seen in the direction of arrow V in FIG. 2.

The upper surface layer 36 includes an undulating surface in the form of alternating caps 40 and cups 42, as shown in FIG. 5.

In the region of the cushion wedge 26 and the raised part a further layer 44 is sandwiched between the layers 36 and 38. This layer 44 is made of resilient low density material, which is less soft than the material of the upper layer 36, but softer than the material of the lower layer 38.

When a person rests on the mattress 10 with his head on the cushion part 26, the side blocks 32, 34 will assist in supporting dorsal muscles in the lumbar region of the body whereas the central raised part 30 will support the lower region of the body of such a person.

The structure of the mattress 10 is specifically designed to provide a comfortable support to the body of a person, in particular in the lumbar regions of the body and thereby to assist in relieving lumbago pains, i.e. muscular pains in the lumbar region.

Although the structure 10 is shown to be in the form of a mattress it also can be shorter to serve as a back support placed onto a chair or on a motor car seat. In such a case the length of the body between the foot edge 20 and the central raised part 30 will be considerably reduced, in fact the edge 20 can be almost adjacent the raised part 30.

The resilient material of the layers 36, 38 and 44 preferably is a soft elastic foamy plastics material of cellular structure, such as for example polyurethane. The different layers 36, 38, 44 may be heat sealed or fused together, e.g. along the borders.

The undulating surface of the upper layer 38 assists in providing ventilation paths when a person lies thereon and also a proper pressure distribution.

I claim:

1. A body support structure in the form of a mattress for supporting a person when lying thereon, comprising:

a body of resilient, compressible material, having a surface layer of resilient soft material, the body including:

a head end edge at one end of the body and a foot end edge at the opposite end of the body;

two substantially parallel straight edges, one at either side of the body;

a bottom face extending between the two side edges of the body;

an upper face opposed to and spaced form the bottom face between the two side edges of the body;

two spaced apart elongated ridges, one of the ridges extending along each side edge, each ridge being substantially straight along the length thereof and having a semicircular shape in cross-section;

a channel provided in the upper face extending between the two ridges, the channel joining smoothly to the two ridges on either side;

a central raised part located in the channel between but distanced away from the opposite end edges and being positioned to support the lumbar region of a person lying in the channel; and side raised parts provided on the ridges adjacent the central raised part.

2. A structure as claimed in claim 1, in which a wedge shaped cushion part is provided extending from the central raised part to the head and edge.

3. A structure as claimed in claim 1, in which the body, in addition to the surface layer of resilient soft material, has a bottom layer of resilient material which is less soft than the material of the surface layer.

4. A structure as claimed in claim 1, in which the surface layer is constituted by undulations int eh form of alternating cups and caps.

* * * * *